US006899255B2

(12) United States Patent
Pringle

(10) Patent No.: US 6,899,255 B2
(45) Date of Patent: May 31, 2005

(54) FOREARM CAMERA MOUNT

(76) Inventor: Christopher Robert Pringle, P.O. Box 58, Dalton, PA (US) 18414

( * ) Notice: Subject to any disclaimer, the term of this patent is extended or adjusted under 35 U.S.C. 154(b) by 40 days.

(21) Appl. No.: 10/606,534

(22) Filed: Jun. 26, 2003

(65) Prior Publication Data

US 2004/0262342 A1 Dec. 30, 2004

(51) Int. Cl.[7] ..... G03B 17/56

(52) U.S. Cl. ..... 224/221; 224/219; 224/267; 224/901.4; 224/908; 396/423

(58) Field of Search ..... 224/219, 220, 224/221, 222, 267, 908, 901.4; 396/420, 423; 2/160

(56) References Cited

U.S. PATENT DOCUMENTS 1,200,403 A * 10/1916 Weyer ..... 224/221
3,966,101 A * 6/1976 Taylor, III ..... 224/219
4,136,805 A * 1/1979 Storms ..... 224/219
4,432,477 A * 2/1984 Haidt et al. ..... 224/222
4,509,667 A * 4/1985 Meldrum ..... 224/222
4,692,807 A * 9/1987 Kee ..... 396/420
5,064,109 A * 11/1991 Caster ..... 224/267
5,244,430 A * 9/1993 Legursky ..... 224/222
D374,767 S * 10/1996 Leach ..... D3/218
5,601,356 A * 2/1997 McWilliams ..... 224/901.4
5,828,917 A * 10/1998 Stephenson ..... 396/424
6,629,628 B1 * 10/2003 Canepari et al. ..... 224/222

* cited by examiner

*Primary Examiner*—Gary E. Elkins

(57) ABSTRACT

The camcorder support includes an arm/wrist band which completely envelopes the arm and wrist to minimize relative movement there between. A thumb hole is provided permitting the arm/wrist band to cover most of the hand while providing free finger and thumb movement. The arm/wrist band and support bracket are strapped to the arm and wrist of the user using straps and fasteners to hold the arm, wrist, support and camcorder in a fixed relationship so that the camcorder movement is basically limited to movement of the user's elbow. The object of the present invention is to provide a new video camera mounting apparatus that allows an archer to hold the bow while the video camera records.

8 Claims, 4 Drawing Sheets

FOREARM CAMERA MOUNT

CROSS REFERENCE TO RELATED APPLICATION

This application is entitled to the benefit of prior provisional application No. 60/391,218 filed 26 Jun. 2002.

BACKGROUND OF THE INVENTION

Video camera mountings consisting basically of familiar expected and obvious structural configurations are known in the art and have been developed for the fulfillment of countless objectives and requirements. Known prior art devices include U.S. Pat. Nos. 4,244,500; 4,509,667; 4,692,807; 4,746,043; and 5,229,798. While these devices fulfill their particular respective objectives and requirements, none of the aforementioned devices allow the hand free use or proper camera angle for filming an archery shot.

BRIEF SUMMARY OF THE INVENTION

The present invention relates to video camera mounting and more particularly pertains to a new video camera mounting apparatus for mounting to a person's forearm for use in, but not limited to, archery.

The camcorder support includes an arm/wristband which completely envelopes the arm and wrist to minimize relative movement there between and a support bracket for supporting and positioning the camera/camcorder. A thumb hole is provided permitting the arm/wrist band to cover most of the hand while providing free finger and thumb movement.

The arm/wrist band and support bracket are strapped to the arm and wrist of the user using straps and fasteners to hold the arm, wrist, support and camera/camcorder in a fixed relationship so that movement of the camera/camcorder is basically limited to movement of the user's elbow.

It is therefore an object of the present invention to provide a new video camera mounting apparatus that allows an archer to hold the bow while the video camera records.

DETAILED DESCRIPTION OF THE PREFERRED EMBODIMENT

Figure 1:
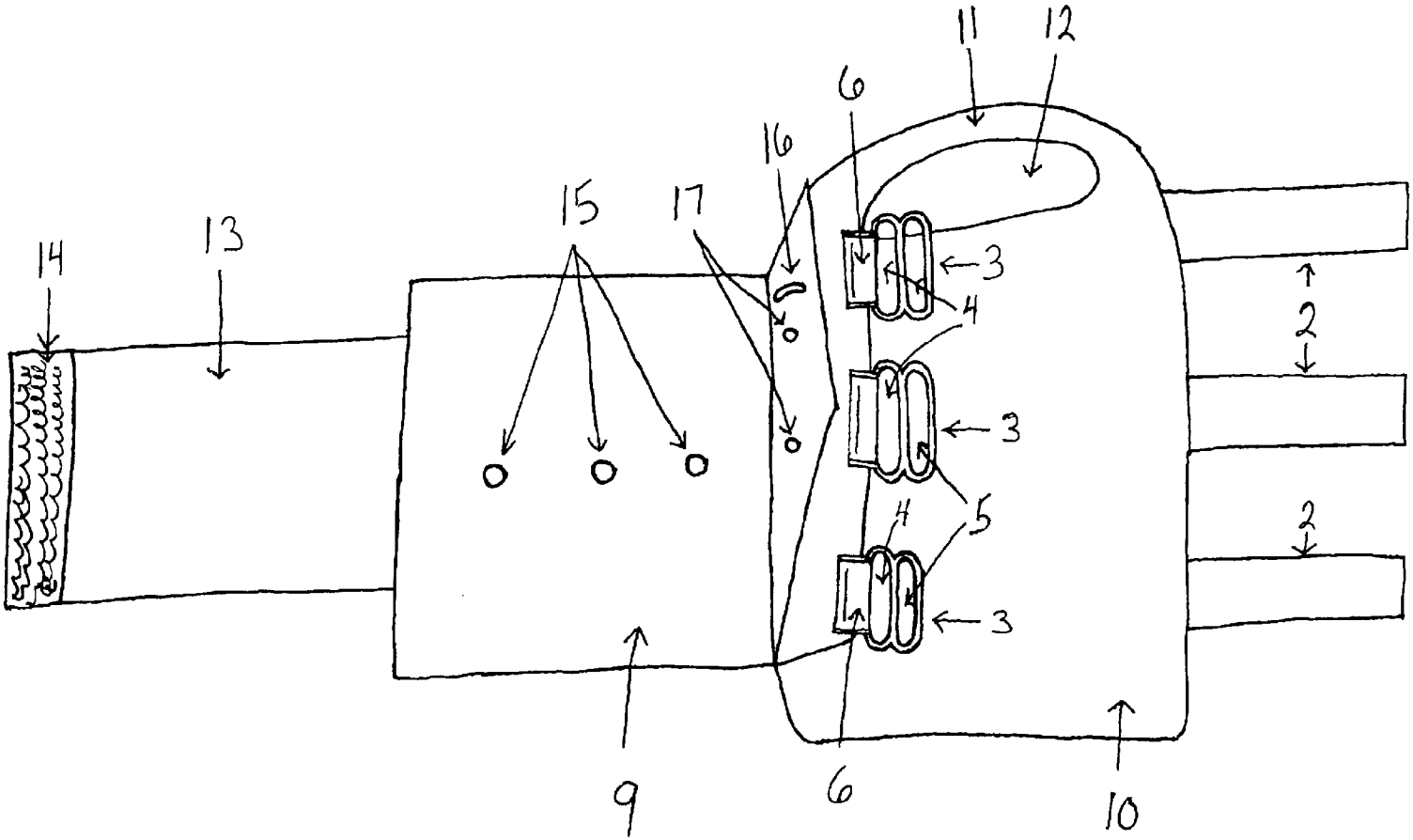
FIG. 1 is a rear elevational view of the forearm camera support in its disassembled form.
Figure 2:
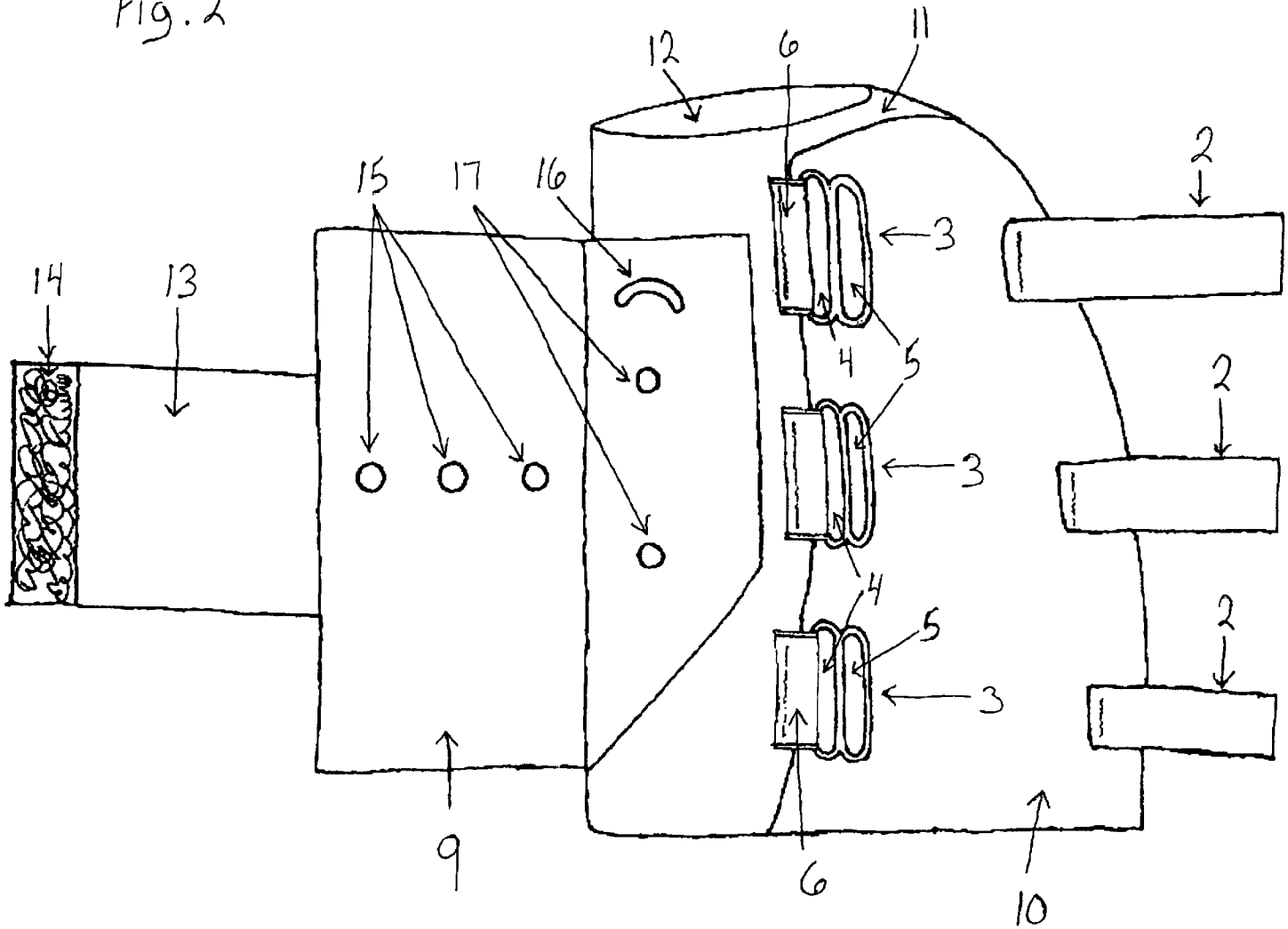
FIG. 2 is a side perspective view of the forearm camera support in its disassembled form.
Figure 3:
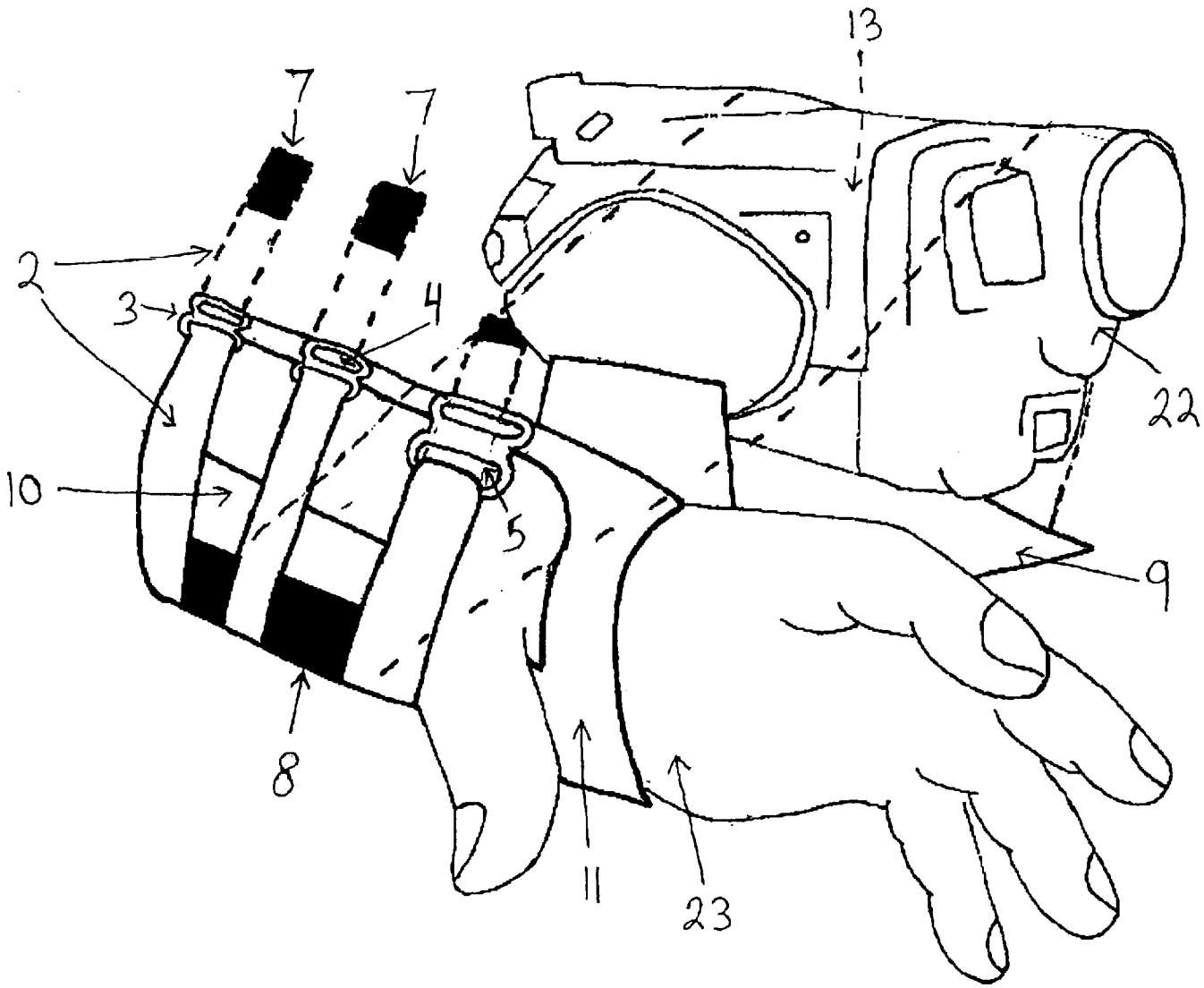
FIG. 3 is a side perspective view of the camera and the forearm camera support in its assembled form.
Figure 4:
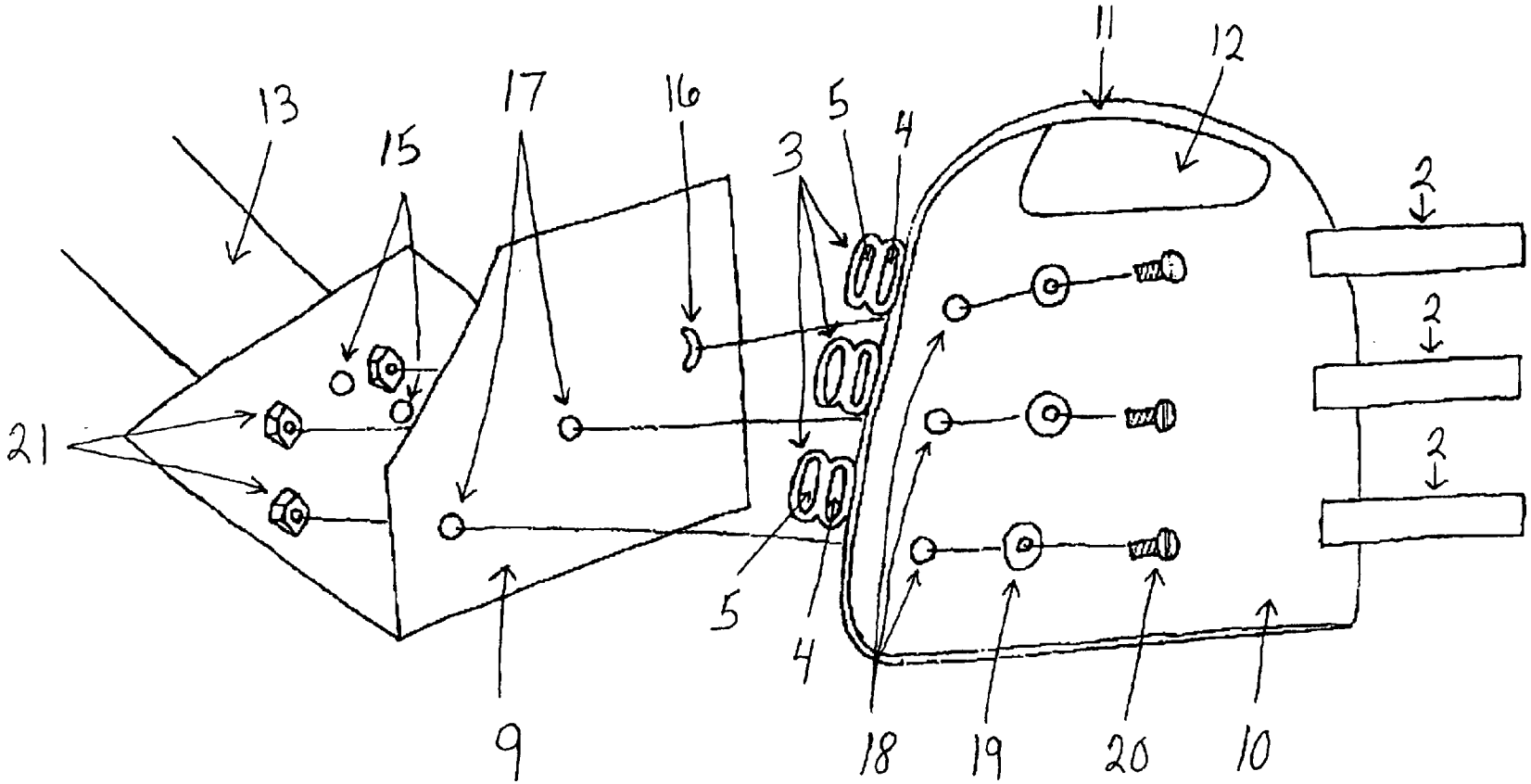
FIG. 4 is a rear elevational view of the arm/wrist band and the bracket in their disassembled form.

The camcorder bracket 9 of the present invention is designed to support a camcorder, videocam or other lightweight video camera 22 by mounting it to a person's forearm 23 using an arm/wrist band 10.

In the preferred embodiment, the arm/wrist band 10 and the palm strap 11 are made of leather or other suitable, flexible and non-stretchable material. The arm/wrist band 10 includes multiple holes 18, clips 9 each including two slots 4, 5, a Velcro fastening material 8 extending along substantially ⅔ of the length of the outer surface of the band or glove 10, straps 2 secured to a side of the band or glove opposite the clips 9, Velcro connectors 7 located on the straps 2, and a palm strap 11 connected to the arm/wrist band 10. While Velcro brand fastening material is used for the connecting elements 7 and 8 because of the convenience and inherent adjustability to accommodate the varying physical contours of users, it is readily understood by those skilled in the art that other known fastening means could be utilized without departing from the spirit and scope of the invention. Clips 3 are secured to the band 10 via material 6 extending through the slots 4 and sewed to the band at the ends of the material.

The support bracket 9 is made of a relatively rigid, unitary construction and is formed from a material such as steel, hard plastic or the like. The bracket 9 comprises multiple bore holes 15 formed in one section of the bracket for mounting the camera 22 via the video camera tripod mounting hole. The location of the tripod mounting hole for the particular camera one wishes to mount to the device will determine which of holes 15 is used. One of the holes 15 is also used to connect the camera securing strap 13 to the bottom of bracket 9. The bracket 9 further comprises curved slot 16 and holes 17 formed in an angled section of the bracket. Holes 17 are used for assembling the bracket to the band 10 and also enable vertical movement of the bracket 9 relative to the band 10. Curved slotted hole 16 permits vertical adjusting or tilting of the bracket and camera relative to the band and arm of the user.

The bracket 9 is connected to the band 10 by screws 20 inserted through washers 19, through holes 18 within the band and then through holes 16, 17 in the bracket 9. Locking nuts 21 are then screwed onto the shank of the screws or bolts 20. When secured, the inner surface of the bracket 9 will lie flush with the outer surface of the band 10.

In use, the band 10 and palm strap 11 are positioned over the forearm and hand of the user with four fingers extending through slot 12. Straps 2 are positioned around the forearm of the user, through slots 5 and then secured via the fastening material 7 and 8 onto the band 10. Camera 22 is mounted to the bracket using one of the holes 15 and then strap 13 is wrapped around the camera and secured to the band using the fasteners 14 and 8. Strap 13 helps stabilize the movement of the camera 22. To facilitate recordation of the archery shot, adjustment of the camera and bracket is provided by the connection of the bracket to the band at holes 16 and 17. Also, the use of palm strap 11 to engage the fingers of the hand assists in accurately positioning the device along the forearm.

Although but one embodiment of the present invention has been illustrated and described, it will be apparent to those skilled in the art that various changes and modifications may be made therein without departing from the spirit of the invention or the scope of the appended claims.

What is claimed is:

1. A forearm mountable support for holding a camera comprising:

a band for securing the support to the forearm and wrist of a user, said band including first mounting holes, and securing elements for securing the band around the forearm of the user;

a rigid bracket including first and second elongated sections angled with respect to one another, each section including a length and a width, said first section including at least one hole for mounting the camera via a tripod mounting hole on the camera to the bracket, said second section including second mounting holes, said first and second mounting holes receiving fasteners securing the band and bracket together;

said bracket positioned in use with said length of each of the first and second sections of the bracket extending substantially parallel to the forearm of the user, the width of the first section extending at an angle away from forearm of the user and the width of the second section extending substantially transversely along the forearm of the user such that, in use, the camera is positioned along the forearm of the user permitting the camera to record an archery bow shot while simultaneously holding and using a bow to shoot an arrow.

2. The forearm mountable support of claim 1 wherein said band includes a palm strap defining a slot for receiving four fingers of a user's hand.

3. The forearm mountable support of claim 1 wherein said securing elements include securing straps attached to one edge of the band, clips each comprising two slots and secured to an opposing edge of the band, a first connecting element on each said strap and a second connecting element on said band matable with said first connecting elements;

each said strap adapted to extend through one of said slots in one of said clips back over the respective strap such that said connecting elements mate with one another and secure said band to the user.

4. The forearm mountable support of claim 1 wherein said second mounting holes in said band include a curvilinear hole permitting adjustment of the bracket and camera relative to the band.

5. The forearm mountable support of claim 1 wherein said at least one mounting hole for mounting the camera includes multiple mounting holes positioned such that one of a plurality of different cameras may be mounted on the bracket in a selected one of the mounting holes dependent upon the position of a tripod mounting hole of the selected camera.

6. The forearm mountable support of claim 1 further including a camera stabilizing strap secured to said bracket and capable of extending over the camera when mounted on the bracket.

7. The forearm mountable support of claim 6 wherein said stabilizing strap includes a fastener capable of mating with at least one of said securing elements of said band to secure said stabilizing strap over the camera.

8. The forearm mountable support of claim 6 wherein said camera stabilizing strap is secured to said bracket via the at least one hole for securing the camera to the bracket.

* * * * *